US009819112B2

(12) United States Patent
Koester

(10) Patent No.: US 9,819,112 B2
(45) Date of Patent: Nov. 14, 2017

(54) RETAINING BLOCK AND MODULAR PLUG INSERT

(71) Applicant: TE Connectivity Germany GmbH, Bensheim (DE)

(72) Inventor: Jens Koester, Rossdorf (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/171,455

(22) Filed: Jun. 2, 2016

(65) Prior Publication Data

US 2016/0359258 A1 Dec. 8, 2016

(30) Foreign Application Priority Data

Jun. 3, 2015 (DE) ..... 10 2015 210 336

(51) Int. Cl.

| | |
|---|---|
| ***H01R 13/514*** | (2006.01) |
| ***H01R 13/436*** | (2006.01) |
| ***H01R 13/424*** | (2006.01) |
| ***H01R 13/502*** | (2006.01) |
| ***H01R 13/506*** | (2006.01) |

(52) U.S. Cl.

CPC ..... *H01R 13/436* (2013.01); *H01R 13/424* (2013.01); *H01R 13/502* (2013.01); *H01R 13/506* (2013.01); *H01R 13/514* (2013.01)

(58) Field of Classification Search

CPC ..... H01R 13/506
USPC ..... 439/686, 695, 752
See application file for complete search history.

(56) References Cited

U.S. PATENT DOCUMENTS

| | | | | |
|---|---|---|---|---|
| 3,402,382 | A * | 9/1968 | De Tar | H01R 13/42 439/469 |
| 4,923,413 | A * | 5/1990 | Michaels | H01R 4/72 439/284 |
| 4,960,393 | A | 10/1990 | Stoll et al. | |
| 6,780,068 | B2 * | 8/2004 | Bartholoma | H01R 13/648 439/752 |
| 6,805,590 | B2 * | 10/2004 | Kato | H01R 13/4367 439/638 |
| 7,044,789 | B2 * | 5/2006 | Yohn | H01R 13/6592 439/599 |
| 7,467,978 | B2 * | 12/2008 | Sundermeier | H01R 9/031 439/320 |
| 7,470,157 | B2 * | 12/2008 | Hiramatsu | H01R 13/4365 439/595 |

(Continued)

FOREIGN PATENT DOCUMENTS

DE 19931728 A1 1/2001

OTHER PUBLICATIONS

European Search Report, dated Oct. 27, 2016, 8 pages.
Abstract of DE19931728, dated Jan. 11, 2001, 1 page.
German Office Action, dated Apr. 21, 2016, 4 pages.

*Primary Examiner* — Neil Abrams
(74) *Attorney, Agent, or Firm* — Barley Snyder

(57) ABSTRACT

A retaining block for a modular plug insert is disclosed. The retaining block for a modular plug insert comprises a first retaining block having a first plug-end surface, a first cable-end surface, a first outside contour surrounding the first plug-end surface and the first cable-end surface, and a first receiving opening receiving a contact, the first receiving opening extending from the first plug-end surface to the first cable-end surface and open to the first outside contour.

19 Claims, 9 Drawing Sheets

(56) References Cited

U.S. PATENT DOCUMENTS

| | | | | |
|---|---|---|---|---|
| 7,789,718 | B2 * | 9/2010 | Desard | H01R 4/36 439/276 |
| 8,408,950 | B2 * | 4/2013 | Jeon | H01R 13/4365 439/595 |
| 8,591,268 | B2 * | 11/2013 | Reimchen | H01R 9/03 439/689 |
| 8,926,364 | B2 * | 1/2015 | Saitoh | H01R 13/4364 439/595 |
| 9,484,667 | B2 * | 11/2016 | Ichio | B60L 11/1818 |
| 2005/0112953 | A1 * | 5/2005 | Ratchford | H01R 13/436 439/695 |
| 2005/0227545 | A1 * | 10/2005 | Lahoreau | H01R 13/502 439/695 |
| 2012/0034809 | A1 | 2/2012 | Reimchen | |
| 2016/0049747 | A1 | 2/2016 | Yu et al. | |

* cited by examiner

RETAINING BLOCK AND MODULAR PLUG INSERT

CROSS-REFERENCE TO RELATED APPLICATIONS

This application claims the benefit of the filing date under 35 U.S.C. §119(a)-(d) of German Patent Application No. 102015210336.6, filed Jun. 3, 2015.

FIELD OF THE INVENTION

The present invention relates to an electrical connector, and more particularly, to a retaining block and modular plug insert of an electrical connector.

BACKGROUND

Retaining blocks and modular plug inserts for electrical connectors are known in the prior art. In the known solutions, contacts are introduced along a plug-in direction of a fitted plug into the retaining block and fixed in the retaining block with, for example, a latching hook. Each contact can have its own latching hook. The modular plug insert, in which the cables are fastened with the latching hook, must further be fastened in the plug housing, thereby requiring a second locking means. This locking can be carried out by further latching hooks, by a screwed-in locking, or by extrusion-coating of the contacts. Fastening the cables in the retaining block or plug insert increases the difficulty in mounting the plug insert, and further, increases the required size of a mating face of the plug insert.

SUMMARY

An object of the invention, among others, is to provide a modular plug insert with retaining block which minimizes the required size of a mating face while also simplifying mounting. The disclosed retaining block for a modular plug insert comprises a first retaining block having a first plug-end surface, a first cable-end surface, a first outside contour surrounding the first plug-end surface and the first cable-end surface, and a first receiving opening receiving a contact, the first receiving opening extending from the first plug-end surface to the first cable-end surface and open to the first outside contour.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail below with reference to embodiments of a modular plug insert. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 8:
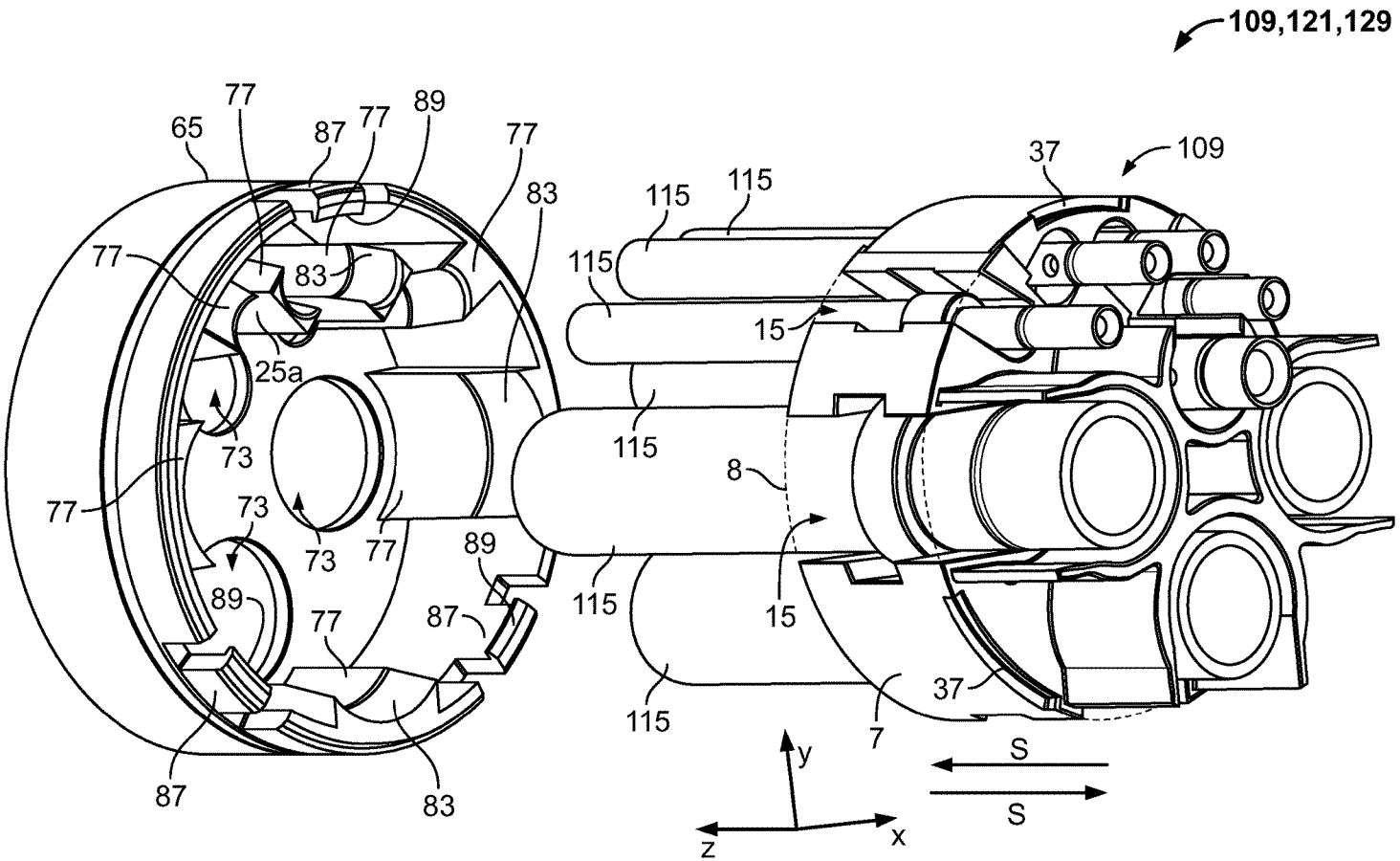
FIG. 8 is an exploded view of modular plug insert according to the invention.
Figure 9:
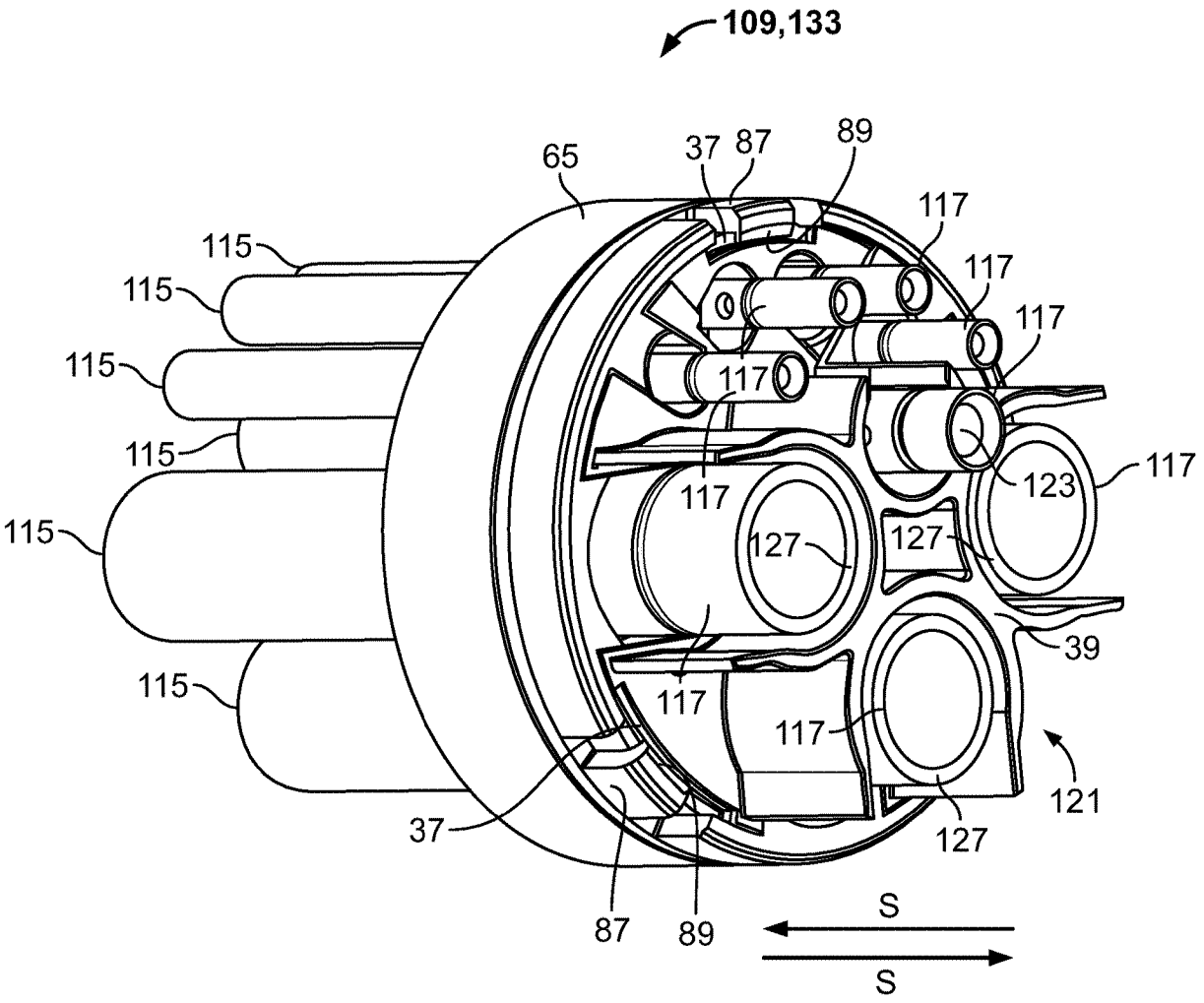
FIG. 9 is a perspective view of the modular plug insert shown in FIG. 8.

The modular plug insert 109 of the invention is shown generally in FIGS. 8 and 9. The modular plug insert 109 includes a first retaining block 1, a second retaining block 57, a securing sleeve 65, and a plurality of contacts 93. The major components of the invention will now be described in greater detail.

Figure 1:
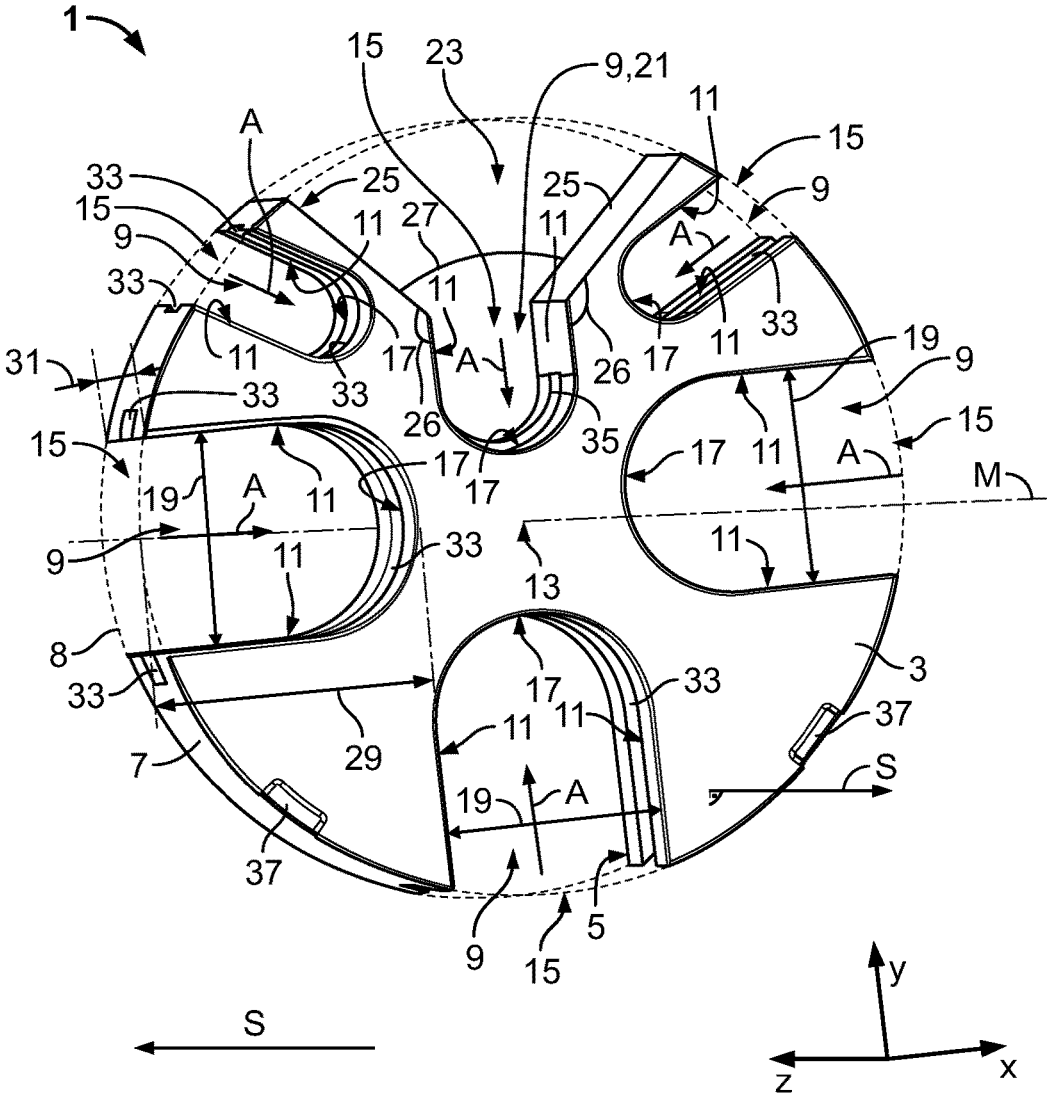
FIG. 1 is a perspective view of a first retaining block according to the invention.

The first retaining block 1 is shown in FIG. 1. First retaining block 1 has a first cable-end surface 3 and a first plug-end surface 5. First plug-end surface 5 can be parallel to first cable-end surface 3, but cannot be seen in FIG. 1. The z-axis shown in FIG. 1 characterizes a plug-in direction S, wherein plug-in direction S and the z-axis in the embodiment shown are in each case perpendicular to first plug-end surface 5. Counter-plug-in direction S' is perpendicular to first cable-end surface 3.

First outside contour 7 of first retaining block 1 shown in FIG. 1 is circular, wherein the first outside contour 7 is interrupted by a plurality of receiving openings 9. Retaining contour 8 described in greater detail below is also shown in FIG. 1, and is indicated by a dashed line. A central axis M runs through a centre point 13 of the retaining contour 8, wherein the centre point 13 is located both on first cable-end surface 3 and on first plug-end surface 5. Central axis M furthermore runs along plug-in direction S, counter-plug-in direction S' and the z-axis.

Figure 5:
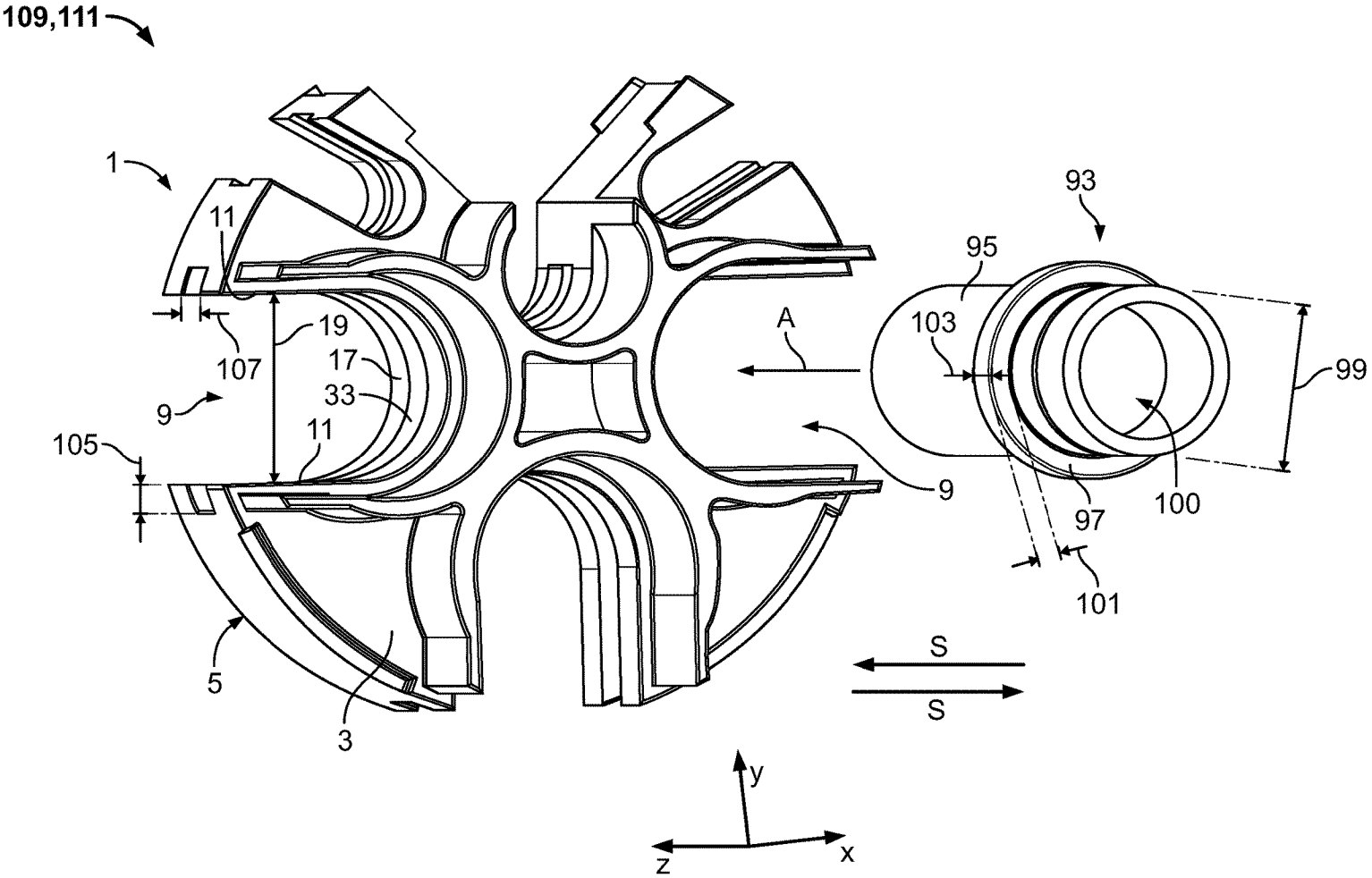
FIG. 5 is a perspective view of the first retaining block shown in FIG. 2 and a contact.

Each of the plurality of receiving openings 9, as shown in FIG. 1, has an inner wall 11, an orifice 15, a bend 17, and a plurality of grooves 33. The inner walls 11 of a receiving opening 9 are parallel to one another and are separated by a distance 19 which defines the orifice 15. For the sake of clarity, this distance 19 of inner walls 11 is only shown for the three largest receiving openings 9 in FIG. 1. The orifice 15 of a receiving space 9 is positioned along the retaining contour 8 to interrupt the first outside contour 7. The bend 17 is positioned opposite the orifice 15 and is semi-circular. Grooves 33 begin at the first outside contour 7 and run along inner walls 11 and bend 17. As shown in FIG. 5, the grooves 33 have a groove width 107 and a groove height 105.

In addition to the distance 19 of inner walls 11, receiving openings 9 have a receiving depth 29 and a receiving height 31. For the sake of clarity, receiving depth 29 and receiving height 31 are only marked on receiving opening 9 drawn on the left in FIG. 1, but can be applied to all receiving openings 9 present.

The inner wall 11 and orifice 15 of each receiving opening 9 define a receiving direction A. As shown in FIG. 1, receiving directions A of all receiving openings 9 extend in a direction different to one another, but all extend transverse to the z-axis. In the embodiment shown, receiving directions A lie parallel to respective inner walls 11 of receiving openings 9 and are also oriented perpendicular to the central axis M.

The first retaining block 1 also has an inner receiving opening 21 shown in FIG. 1; like reference numbers indicate like elements with respect to the plurality of receiving openings 9. The orifice 15 of said inner receiving opening 21 does not lie on retaining contour 8. A receiving region 23, the width of which increases from orifice 15 towards retaining contour 8, adjoins inner receiving opening 21. The receiving region 23 is delimited by two receiving surfaces 25. Receiving surfaces 25 are positioned at a receiving angle 27 with respect to one another, and each inner wall 11 of inner receiving opening 21 extends at an angle 26 with respect to adjoining receiving surface 25. Inner receiving opening 21 does not have a groove 33, but rather an elevation 35 with a rectangular cross-section. Elevation 35 runs along inner walls 11 and bend 17 of inner receiving opening 21.

A plurality of latching openings 37 are positioned to interrupt both the first cable-end surface 3 and the first outside contour 7. Latching openings 37, as shown in FIG. 1, may be cube-shaped recesses, wherein the latching openings 37 are larger in the plane of first cable-end surface 3 than in the z-direction.

The first retaining block 1 can be configured as a solid body or hollow body. If the retaining block is configured as a hollow body, the first plug-end surface 3 and the first cable-end surface 5 respectively represent a plate which can be connected to one another, for example, via webs. In the case of this configuration, the two first surfaces 3, 5 are connected to one another only via webs of any desired form and the receiving openings 9 can be present in each of the two first surfaces 3, 5 separately but opposite one another. In this case, the inner side of each receiving opening 9 comprises two strip-shaped surfaces. The first retaining block 1 can be configured as a solid body, i.e. the inner side of each receiving opening 9 is a continuous surface.

The inner side of the receiving opening 9 can be provided with a functional coating, mechanically treated or provided, for example, with a rubber coating. For example, friction-reducing layers or a coating which reduces abrasive wear can be considered as the functional coating. It is also conceivable that the inner side of the receiving opening 9 is provided with a structure which increases, for example, the friction with a contact member 93 to be inserted later.

The receiving openings 9 cannot only be arranged as desired along the first outside contour 7, but rather can also have different depths and/or widths. One with ordinary skill in the art would understand that a variety of combinations of receiving opening 9 arrangements, widths and depths are possible. As a result of this combination of the position, depth and width of the receiving openings 9, a very wide range of mating faces can be realized which can correspond to different standards.

Figure 2:
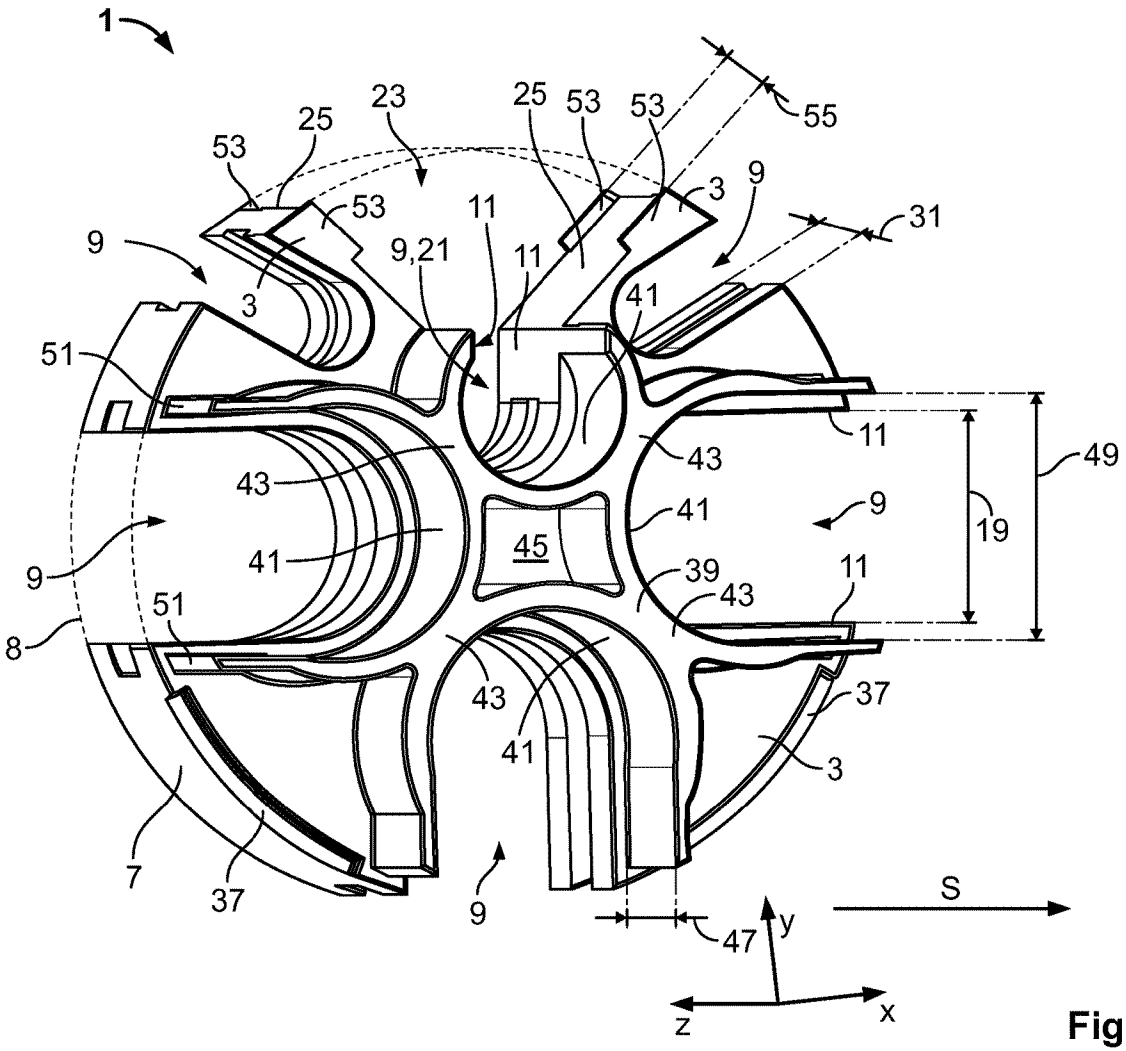
FIG. 2 is a perspective view of a first retaining block according to another embodiment of the invention.

Another embodiment of the first retaining block 1 is shown in FIG. 2. Like reference numbers indicate like elements with respect to the first retaining block 1 shown in FIG. 1.

In the embodiment of the first retaining block 1 shown in FIG. 2, first cable-end surface 3 is now not only interrupted by receiving openings 9, but also by a wall 39. Wall 39 projects out of first cable-end surface 3 in counter-plug-in direction S'. Wall 39, in the embodiment shown in FIG. 2, has four wall portions 41 which merge into one another at four contact points 43. These contact points 43 stabilize the wall 39 and furthermore form a cavity 45.

Wall portions 41 represent substantially an elongation of inner walls 11 of receiving openings 9. Receiving height 31 of receiving openings 9 is increased by wall height 47. Wall portions 41 have a wall distance 49 which is larger than distance 19 of inner walls 11 of the corresponding receiving opening 9, as shown in FIG. 2. Wall surfaces 51 of wall portions 41 are positioned offset from the first outside contour 7 toward the inside of the first retaining block 1.

Receiving surfaces 25 which partially surround receiving region 23 have additional guide members 53. These guide members 53 are offset from first cable-end and plug-end surfaces 3, 5 and partially enclose receiving region 23. The portion of receiving region 23 which is surrounded by guide members 53 has a guide width 55 which, since measured on the inner side of the guide members 53, is smaller than receiving height 31.

The latching openings 37 of the first retaining block shown in FIG. 2 are greatly enlarged along the circumference of first outside contour 7.

Figure 3:
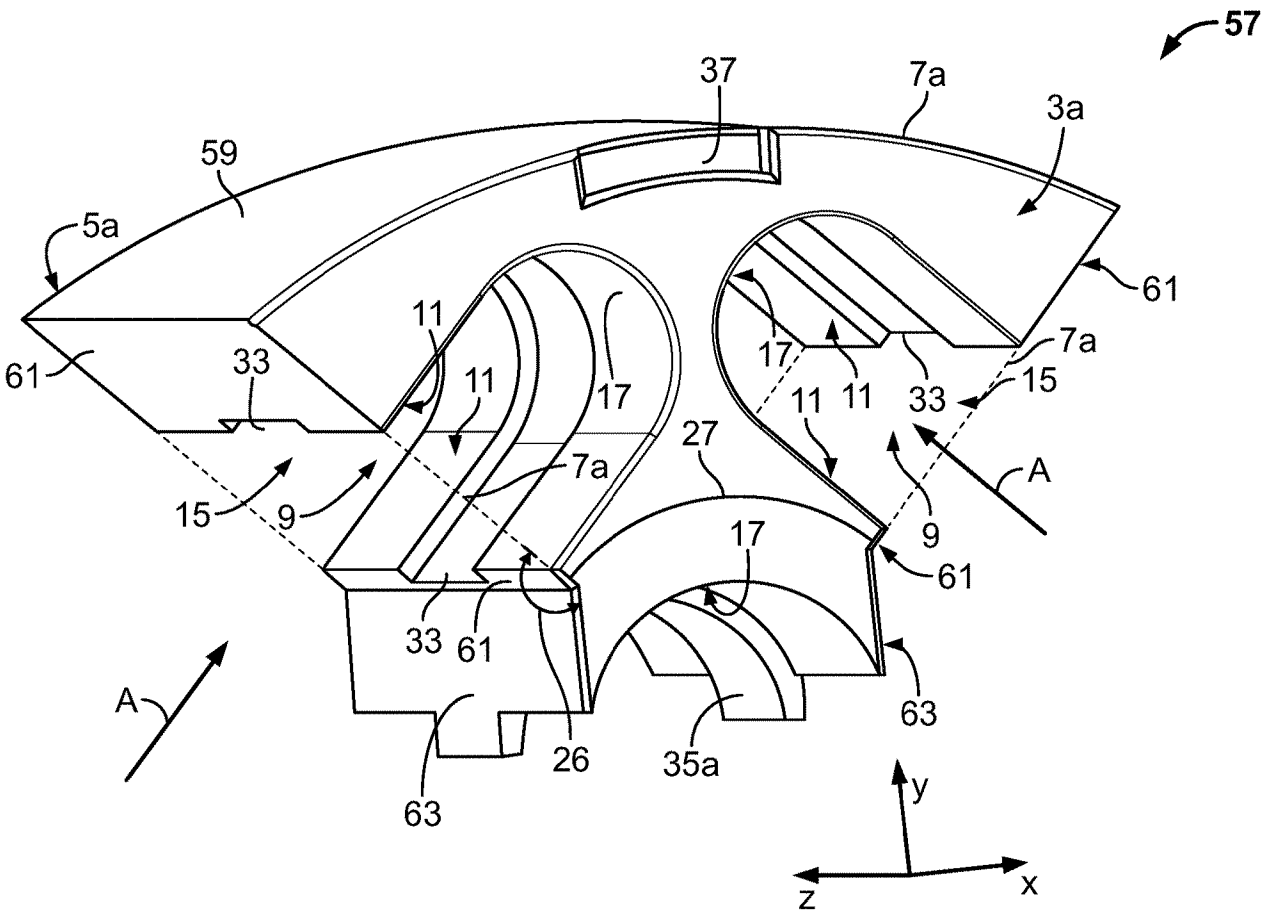
FIG. 3 is a perspective view of a second retaining block according to the invention.

The second retaining block 57 is shown in FIG. 3. Second retaining block 57 has substantially the same elements as first retaining block 1 of FIGS. 1 and 2, wherein like reference numbers indicate like elements. The second retaining block 57 has two receiving openings 9 with inner walls 11 and bends 17 along which a continuous groove 33 respectively runs. Inner walls 11 of shown second retaining block 57 are also parallel to one another and parallel to a receiving direction A.

Shown second retaining block 57 has a second cable-end surface 3*a* and a second plug-end surface 5*a*. Both second surfaces 3*a*, 5*a* are arranged parallel to one another in the exemplary embodiment and also parallel to both shown receiving directions A. Second cable-end surface 3*a* and second plug-end surface 5*a* are partially surrounded by a bent edge 59, wherein said edge 59 defines a second outside contour 7*a*.

Second retaining block 57 also has a latching opening 37 which interrupts second cable-end surface 3*a* and the edge surface 59. Second retaining block 57 further has two upper receiving surfaces 61 which are each interrupted by orifices 15 of receiving openings 9 so that each upper receiving surface 61 is composed of two partial surfaces. Two lower receiving surfaces 63 extend parallel to one another at an end of the second retaining block 57 distal from bent edge surface 59. The upper receiving surfaces 61 span at the angle 27 with respect to each other, and at the angle 26 with respect to adjoining receiving surfaces 63. A bend 17 extends between lower receiving surfaces 63. A second elevation 35*a* is positioned on and follows the bend 17.

The first and second retaining blocks 1, 57 can be manufactured from the same material or from different materials. Different materials can serve to differentiate between the retaining blocks 1, 57. For the purpose of differentiation and improved mounting of several retaining blocks, these can additionally have a marking which can be realized, for example, by a color coding and/or a coding by means of a surface structure.

Figure 4:
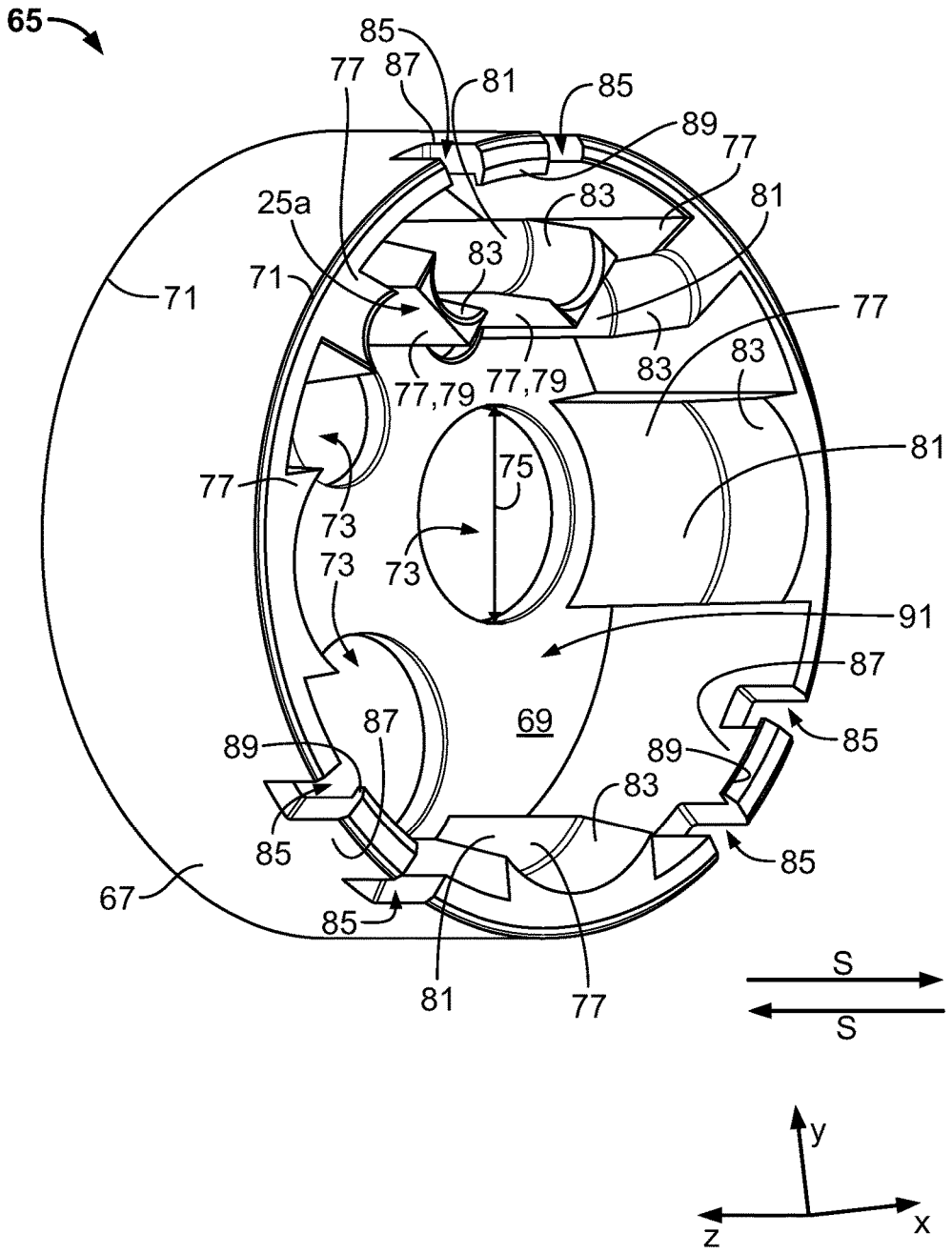
FIG. 4 is a perspective view of a securing sleeve according to the invention.

The securing sleeve 65 is shown in FIG. 4. The securing sleeve 65 has a ring 67, a surface 69, and a plurality of locking mechanisms 77.

The surface 69 is a substantially planar element which merges into ring 67 at an edge 71 pointing in plug-in direction S. Both surface 69 and edge 71 span a plane which is parallel to the x-y plane and perpendicular to the z-axis. Surface 69 has several round bores 73 which have a diameter 75. Diameter 75 can be different for bores 73 or have the same value for specific bores 73.

The locking mechanisms 77 extend away from the surface 69 in the counter-plug-in direction S'. Locking mechanisms 77 may be free-standing locking mechanisms 79, or may be connected to ring 67. Locking mechanisms 77 each correspond to a bore 73, wherein a curved surface 81 aligned with a corresponding bore 73 has the same curvature as the corresponding bore 73. Curved surface 81, as shown in FIG. 4, is positioned offset from corresponding bore 73.

Locking mechanisms 77 additionally have a chamfer 83 at the end of locking mechanism 77 pointing in counter-plug-in direction S'. Curved surface 81, which also runs in the region of chamfer 83, inclines away from the associated bore 73 in this region, as best shown in the bottom curved surface 81 of FIG. 4.

Free-standing locking mechanisms 79 additionally have a free-standing receiving surface 25*a* opposite respective curved surface 81.

Edge 71 of securing sleeve 65 pointing in counter-plug-in direction S' has recesses 85 which form a flexible latching member 87. The free ends, pointing in counter-plug-in direction S', of latching members 87 are equipped with latching hooks 89 which point in the direction of a receiving region 91 formed by surface 69 and ring 67. Receiving region 91 is, in the configuration depicted here of securing sleeve 65, accessible in plug-in direction S, whereas receiving region 91 is not accessible in counter-plug-in direction S', since it is delimited by surface 69.

One of the plurality of contacts 93 is shown in FIG. 5. Contact 93 has a cylindrical base body 95 and a bead 97. Cylindrical base body 95 has an outer diameter 99 which is less than or equal to distance 19 of inner walls 11 of corresponding receiving opening 9. A cavity 100 is surrounded by cylindrical base body 95. Bead 97 has a rectangular cross-section and is configured to be circumferential continuously around the cylindrical base body 95. Bead 97 may be formed by a separate ring which is pushed onto cylindrical base body 95, or may be a moulded component of cylindrical base body 95. Bead 97 has a bead height 101 and a bead width 103. The bead height 101 corresponds substantially to the groove depth 105 of the first retaining block 1, and the bead width 103 corresponds substantially to the groove width 107.

The assembly of the modular plug insert 109 will now be described with reference to FIGS. 5-9.

FIG. 5 shows the assembly of the contact 93 with the first retaining block 1 of the embodiment shown in FIG. 2; a pre-mounting position 111 of the modular plug insert 109. Cylindrical base body 95 extends along plug-in direction S or counter-plug-in direction S' and is thus perpendicular to first cable-end and first plug-end surface 3, 5 of first retaining block 1. Contact 93 is displaceable along receiving direction A and can be inserted along said receiving direction A into receiving opening 9 in such a manner that circumferential bead 97 engages in groove 33 of receiving opening 9 and is guided in groove 33 until bend 17 is reached.

Figure 6:
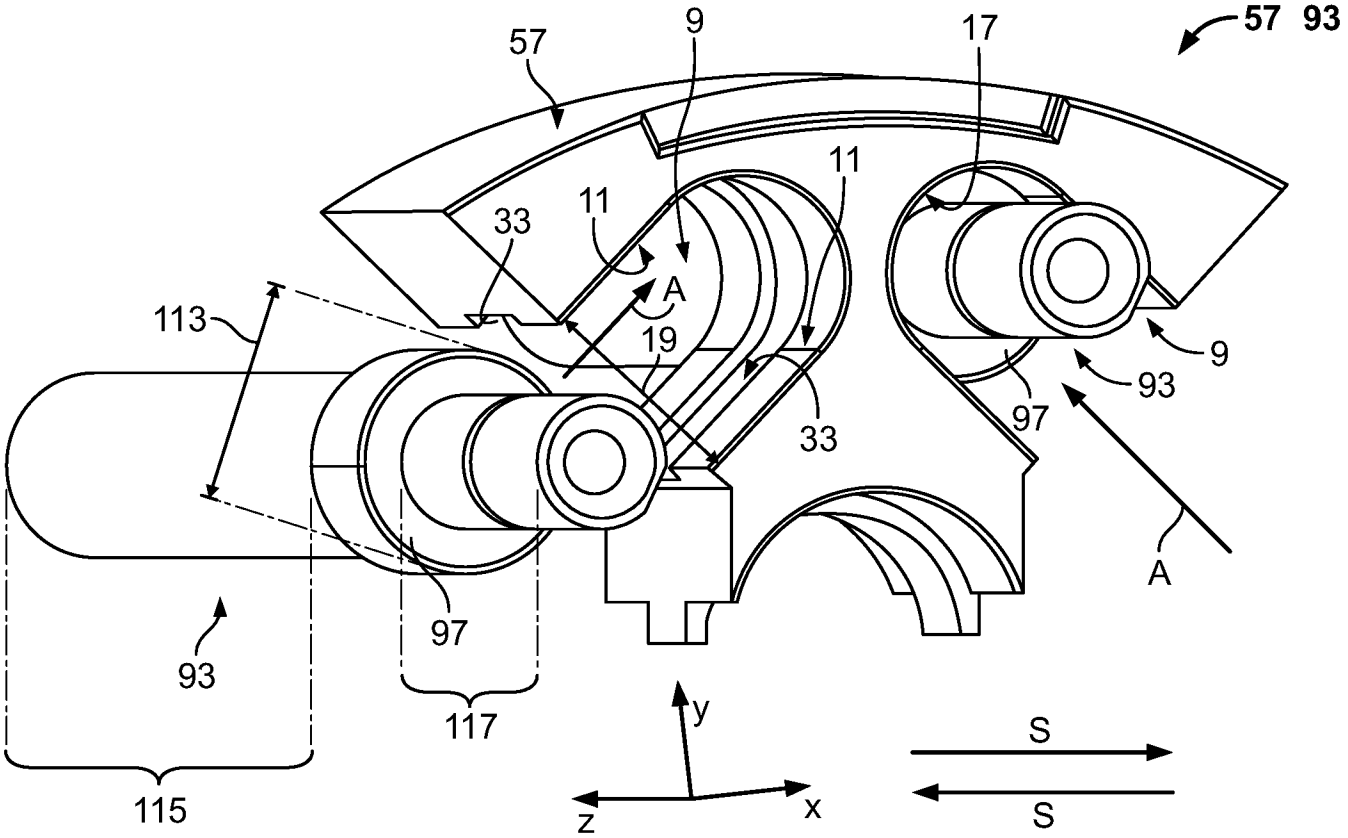
FIG. 6 is a perspective view of the second retaining block shown in FIG. 3 and a plurality of contacts.

The assembly of the second retaining block 57 and two contacts 93 is shown in FIG. 6. Insertion of contact 93 into corresponding receiving opening 9 is carried out along receiving direction A, wherein circumferential bead 97 of contact 93 engages in groove 33. Groove 33 thus serves as a guide for circumferential bead 97 and consequently also as a guide for contact 93, which moves along receiving direction A without changing the orientation of the contact 93 along plug-in direction S or counter-plug-in direction S'.

As in FIG. 5, bead width 103 of contact 93 shown in FIG. 6 corresponds approximately to groove width 107 of corresponding receiving opening 9. However, contact 93 of FIG. 6 is shown in a second configuration in which plug-end contact portion 115 has an outer diameter 99 which deviates from an outer diameter 99 of cable-end contact portion 117.

Plug-end contact portion 115 extends from circumferential bead 97 in plug-in direction S, whereas cable-end contact portion 117 extends away from circumferential bead 97 in counter-plug-in direction S'. Plug-end bead height 101 thus corresponds to groove depth 105, whereas cable-end bead height 101 exceeds groove depth 105.

Contact 93 in FIG. 6 is retained by means of circumferential bead 97 in groove 33 since outer bead diameter 113 exceeds distance 19 of inner walls 11. The positive locking between circumferential bead 97 and groove 33 prevents a displacement of contact 93 along plug-in direction S or counter-plug-in direction S', but does not prevent contact 93 from being able to be removed counter to original receiving direction A out of receiving opening 9.

The contact 93 can terminate a power cable (not shown). This termination can be realized, for example, in that the contact 93 has a cavity for receiving a cable end. In this cavity, the cable can be connected to the contact 93 in an electrically conducting manner by clamping or soldering.

Figure 7:
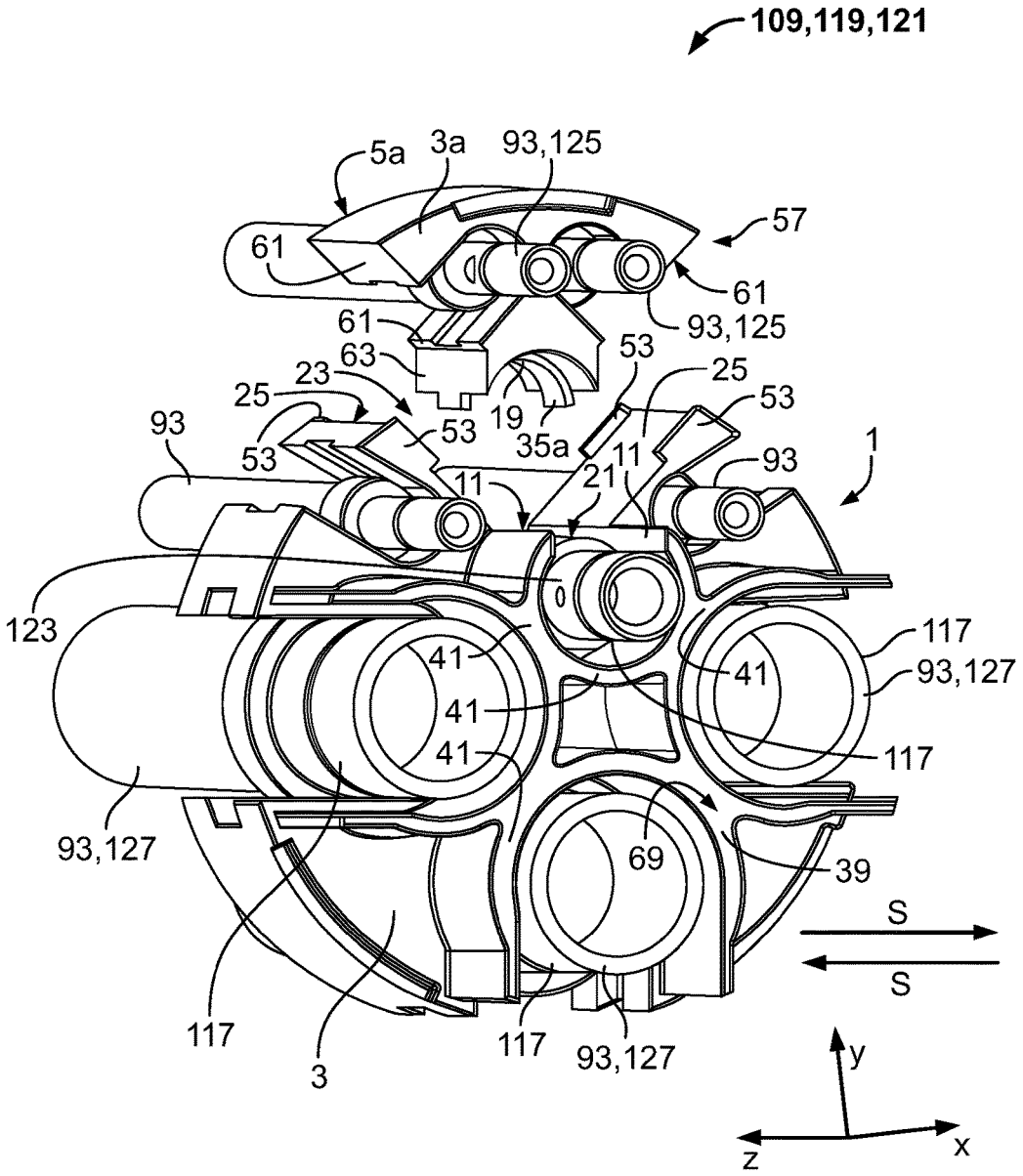
FIG. 7 is a perspective view of the first retaining block shown in FIG. 2, the second retaining block shown in FIG. 3, and a plurality of contacts.

Modular plug insert 109 is shown in a second pre-mounting position 119 in FIG. 7. In this second pre-mounting position 119, contacts 93 with various configurations are inserted into respective receiving openings 9 of first retaining block 1 and second retaining block 57.

In this second pre-mounting position 119, first retaining block 1 and second retaining block 57 are joined together to form a retaining block 121. The second retaining block 57 is moved in a direction counter to the y-axis into receiving region 23 of first retaining block 1. Outer surfaces 63 of second retaining block 57 are guided past receiving surfaces 25 of first retaining block 1 into inner receiving opening 21, wherein said outer surfaces 63 of second retaining block 57 are guided between inner walls 11 of inner receiving opening 21. Just like first retaining block 1, second retaining block 57 has second elevation 35*a* which engages in a groove (not visible in FIG. 7) of inner contact 123. Second retaining block 57 is thus guided along a direction counter to the y-axis by second elevation 35*a* and its engagement in groove 33 of inner contact 123.

During insertion of further contact member 57 into receiving region 23 of first retaining block 1, guide members 53 of first retaining block 1 engage over second cable-end and second plug-end surfaces 3*a*, 5*a* of second retaining block 57. In the case of further movement of second retaining block 57 along a direction counter to the y-axis, outer surfaces 63 of second retaining block 57 slide along inner walls 11 of inner receiving opening 21 until bend 17 of second retaining block 57, which points in a direction counter to the y-axis, contacts inner contact 123. When this position is reached, upper receiving surfaces 61 of second retaining block 57 abut receiving surfaces 25 of first retaining block 1; angle 26 of first retaining block 1 corresponds to angle 26 of second retaining block 57 and receiving angle 27 of first retaining block 1 and of second retaining block 57 are also identical.

By inserting second retaining block 57 into receiving region 23 of first retaining block 1, inner contact 123 is fixed against a movement out of receiving opening 9. Additional contacts 93 shown in FIG. 7 still have no such fixing, but upper contacts 125 are prevented by receiving surfaces 25 of first retaining block 1 from leaving corresponding receiving openings 9.

In this second pre-mounting position 119, all the contacts 93 present are secured against a movement in plug-in direction S or in counter-plug-in direction S' by circumferential bead 97 which engages in groove 33. Inner contact 123 and load contacts 127 each project out of corresponding receiving opening 9 in counter-plug-in direction S' out of the cable-end surface 3, cable-end contact portions 117 of said contacts 93 are in this case surrounded by corresponding wall portions 41 without wall portions 41 contacting plug-end contact portions 115. The cavity between wall portions 41 and cable-end contact portions 117 can be used for isolation (not shown) of cable-end contact portions 117. Wall portions 41 further serve as electrical isolation between load contacts 127 and the inner contact member.

FIG. 7 shows a configuration of the modular plug insert in the case of which that end of load contacts 127 which points in counter-plug-in direction S' is flush with surface 69 of wall 39. This means that cable-end contact portions 117 do not project in counter-plug-in direction S' beyond wall 39, and are also not sunk therein in plug-in direction S. In contrast, inner contact 123 has a cable-end contact portion 117 which projects past surface 69 of wall 39 in counter-plug-in direction S'. This can, for example, be advantageous if inner contact 123 serves as a ground connection, wherein a contact closure of the ground line preferably takes place before the other current-conducting and voltage-conducting lines establish an electrical contact.

FIG. 8 shows modular plug insert 109 in a third pre-mounting position 129. In this third pre-mounting position 129, securing sleeve 65 is moved in counter-plug-in direction S' and fully mounted retaining block 121 is moved in plug-in direction S towards one another.

Plug-end contact portions 115 of contacts 93 are guided by bores 73 in surface 69 of securing sleeve 65. Plug-end contact portions 115 thus project in plug-in direction S through surface 69 and away from it. During further insertion into securing sleeve 65, locking mechanisms 77 engage in counter-plug-in direction S' in orifices 15 of receiving openings 9 which are open to retaining contour 8. Free-standing locking mechanisms 79 engage in receiving openings 9 of second retaining block 57 and slide with their free-standing receiving surfaces 25*a* in counter-plug-in direction S' along receiving surfaces 25 of first retaining block 1.

Since contacts 93 in modular plug insert 109 are not yet fixed in final position 131, chamfer 83 of locking mechanisms 77 is used, if the chamfer 83 comes into contact with circumferential bead 97 of contacts 93, to push contacts 93 along respective receiving direction A fully into receiving opening 9.

When securing sleeve 65 comes into contact with first plug-end surface 5 of retaining block 121, latching members 87 of securing sleeve 65 bend away from retaining block 121 and enable a further pushing in of retaining block 121 into receiving region 91 of securing sleeve 65. In this case, latching hooks 89 slide over first outside contour 7 of first retaining block 1 or over retaining contour 8 of retaining block 121 until said latching hooks 89 latch into latching openings 37 of retaining block 121.

If latching hooks 89 are interlocked with latching openings 37, modular plug insert 109 is in assembled state 133, shown in FIG. 9. In this assembled state 133, the movement of contacts 93 both in plug-in direction S and in counter-plug-in direction S', and a movement along or counter to respective receiving direction A, is prevented.

In assembled state 133, plug-end contact portions 115 project in plug-in direction S out of securing sleeve 65. Cable-end contact portions 117 project in counter-plug-in direction S' out of retaining block 121, wherein load contacts 127 terminate flush with wall 39 in counter-plug-in direction S'. In contrast, inner contact 123 projects in counter-plug-in direction S' beyond wall 39.

Advantageously, in the modular plug insert 109 of the invention, the contacts 93 do not have to be introduced into the retaining block 1 in or counter to the plug-in direction. Inserting the contacts 93 is carried out transverse to a plug-in direction, yet the contacts 93 are still securely held, so that latching hooks for the contacts 93 can be avoided and mounting is made easier. Furthermore, the walls 39 of the embodiment shown in FIG. 2 increase the air and creepage distances of occurring creepage currents, and consequently, permit the contacts 93 to be arranged at a smaller distance from one another, resulting in a smaller mating face.

What is claimed is:

1. A retaining block for a modular plug insert, comprising:
- a first retaining block having
  - a first plug-end surface,
  - a first cable-end surface,
  - a first outside contour surrounding the first plug-end surface and the first cable-end surface, and
  - a first receiving opening receiving a first contact, the first receiving opening extending from the first plug-end surface to the first cable-end surface and open to the first outside contour; and
- a second retaining block engaging the first retaining block in a positive-locking manner and having
  - a second outside contour complementary to the first outside contour, the first outside contour and the second outside contour forming a retaining contour, and
  - a second receiving opening open to the second outside contour and receiving a second contact, and when the second retaining block engages the first retaining block, the first receiving opening is open to the retaining contour and the second receiving opening is closed by the first retaining block.

2. The retaining block of claim 1, wherein the first retaining block has a wall projecting from either the plug-end surface or the cable-end surface.

3. The retaining block of claim 1, wherein the second retaining block has a second plug-end surface and a second cable-end surface, the second outside contour surrounding the second plug-end surface and the second cable-end surface.

4. The retaining block of claim 3, wherein the second receiving opening extends from the second plug-end surface to the second cable-end surface.

5. The retaining block of claim 4, further comprising a securing sleeve.

6. The retaining block of claim 5, wherein the securing sleeve covers an orifice of at least one of the first receiving opening and the second receiving opening.

7. The retaining block of claim 6, wherein the securing sleeve covers the first receiving opening along the retaining contour.

8. The retaining block of claim 7, wherein the securing sleeve covers the second receiving opening along the retaining contour.

9. The retaining block of claim 8, wherein the securing sleeve engages the retaining contour in a positive-locking manner.

10. The retaining block of claim 9, wherein the securing sleeve has a latching hook.

11. The retaining block of claim 10, wherein the latching hook engages with at least one of the first plug-end surface, the first cable-end surface, the second plug-end surface, and the second cable-end surface.

12. A modular plug insert, comprising:

a first retaining block having a first plug-end surface, a first cable-end surface, a first outside contour surrounding the first plug-end surface and the first cable-end surface, and a first receiving opening extending from the first plug-end surface to the first cable-end surface and open to the first outside contour;

a second retaining block engaging the first retaining block in a positive-locking manner and having a second outside contour complementary to the first outside contour, the first outside contour and the second outside contour forming a retaining contour, and a second receiving opening open to the second outside contour, and when the second retaining block engages the first retaining block, the first receiving opening is open to the retaining contour and the second receiving opening is closed by the first retaining block; and a contact insertable into the first receiving opening in a direction transverse to a longitudinal direction of the contact.

13. The modular plug insert of claim 12, wherein the contact is retained in the first receiving opening and secured against displacement in or counter to the longitudinal direction of the contact.

14. The modular plug insert of claim 13, wherein the contact extends perpendicularly to the first plug-end surface and the first cable-end surface.

15. The modular plug insert of claim 13, wherein the contact engages in a positive locking manner with the first receiving opening.

16. The modular plug insert of claim 13, further comprising a securing sleeve covering the first receiving opening.

17. A retaining block for a modular plug insert, comprising:

a first retaining block having a first plug-end surface, a first cable-end surface, a first outside contour surrounding the first plug-end surface and the first cable-end surface, and a first receiving opening receiving a first contact, the first receiving opening extending from the first plug-end surface to the first cable-end surface and open to the first outside contour;

a second retaining block engaging the first retaining block in a positive-locking manner and having a second outside contour complementary to the first outside contour, the first outside contour and the second outside contour forming a retaining contour, and a second receiving opening open to the second outside contour and receiving a second contact; and a securing sleeve engaging the retaining contour in a positive-locking manner.

18. The retaining block of claim 17, wherein the securing sleeve has a latching hook.

19. The retaining block of claim 18, wherein the latching hook engages with at least one of the first plug-end surface, the first cable-end surface, the second plug-end surface, and the second cable-end surface.

* * * * *